US012516917B2

(12) United States Patent
Oberholster et al.

(10) Patent No.: US 12,516,917 B2
(45) Date of Patent: Jan. 6, 2026

(54) EXPANDABLE BULLET

(71) Applicant: PERAMCO (PTY) LTD, Pretoria (ZA)

(72) Inventors: Alliwyn Johannes Oberholster, Pretoria (ZA); Geral-dique Nel, Pretoria (ZA)

(73) Assignee: PERAMCO (PTY) LTD, Pretoria (ZA)

( * ) Notice: Subject to any disclaimer, the term of this patent is extended or adjusted under 35 U.S.C. 154(b) by 44 days.

(21) Appl. No.: 18/678,337

(22) Filed: May 30, 2024

(65) Prior Publication Data

US 2024/0410682 A1 Dec. 12, 2024

(30) Foreign Application Priority Data

Jun. 6, 2023 (ZA) ..... 2023/05968

(51) Int. Cl.
*F42B 12/34* (2006.01)

(52) U.S. Cl.
CPC ..... *F42B 12/34* (2013.01)

(58) Field of Classification Search
CPC ..... F42B 12/34
See application file for complete search history.

(56) References Cited

U.S. PATENT DOCUMENTS

2016/0282095 A1* 9/2016 Hendrixson ..... F42B 12/34
2019/0316888 A1* 10/2019 Thielen ..... F42B 12/34
2023/0045740 A1* 2/2023 Hurt ..... F42B 12/78

* cited by examiner

*Primary Examiner* — J. Woodrow Eldred
(74) *Attorney, Agent, or Firm* — Ballard Spahr LLP

(57) ABSTRACT

The invention discloses an expandable bullet having a set of deformable petals each including a main and set of two small petals, with the petals formed by a pattern of slits across a hollow core of the bullet tip.

11 Claims, 11 Drawing Sheets

EXPANDABLE BULLET

FIELD OF THE INVENTION

This invention relates to an expandable bullet, such as bullets that are typically used in self-defence ammunition.

BACKGROUND TO THE INVENTION

Firearms have various applications, and common to all of these is that a bullet fired from the firearm is intended to hit a target. Only sport shooting applications do not require that a bullet that hits a target inflict damage, other than marking its impact for scoring purposes, to it. Other applications of firearms, such as for hunting and self-defence, require that a bullet inflicts damage to a target to stop and/or kill it.

Bullets used for hunting and self-defence are relatively small projectiles that rely in penetration and damage to vital organs and/or other physical structures in the body of a target to achieve the purpose of stopping or killing it.

Most bullets range in diameter from between about 5 mm and 13 mm, and they weigh from as little as about 3 gram (about 45 grains) to about 40 gram (just over 600 grains) which is relatively small and light compared to typical targets. It is therefore very important for a bullet, whether for hunting or self-defence, to have effective, reliable and predictable terminal ballistics. Terminal ballistics refer to the behaviour and effects of a projectile when it hits and transfers its energy to a target.

Since the time when the shooting of projectiles was invented for the above purposes, bullets have progressed from round balls to solid elongated and shaped projectiles, and eventually to deformable elongated and shaped projectiles. Along the way bullet manufacturers have realised that the terminal ballistics of bullets that deform are better than those that do not deform. A modern expandable bullet is vastly more effective than the round ball projectiles used in muskets.

Conventional wisdom teaches that for optimal terminal ballistics a bullet must 'mushroom' upon impact, in other words it must expand. The purpose of this is to increase the wound channel size in the target, to maximize bleeding, ensure all the kinetic energy in the bullet is transferred to the target and to prevent overpenetration. Overpenetration occurs, according to conventional wisdom, when a bullet passes through a target with or without fully expanding.

In a hunting context overpenetration is not necessarily negative provided the bullet has expanded, and of course passes through a vital zone on its path through the target. In the hunting context overpenetration has an advantage in providing two wound openings in the quarry, which increases bleeding and loss of blood and provides a more prominent blood trial that assist in finding a quarry that does not fall close to where it is shot.

In a self-defence context overpenetration is a very significant problem, mostly for the risk that is poses to bystanders and surrounding structures. Some bullet manufacturers have gone, and still go, to extreme lengths to create frangible bullets to eliminate overpenetration, such as the Glaser safety slug by CorBon (a hollow-point bullet filled with no. 12 birdshot with a flat polymer cap). A problem with these highly frangible bullets is lack of penetration. Although a bullet such as the Glaser safety slug is almost guaranteed not to over penetrate, it suffers from inferior performance when it must penetrate through common urban barriers such as vehicle window glass, sheet metal, plywood, drywall, and heavy clothing. This has relegated bullets such as the Glaser safety slug to extreme niche purposes such as specialized hostage rescue situations.

Conventional self-defense ammunition requires reliable expansion without fragmentation. The expansion of a bullet relies on resistance that the bullet experiences from hitting a target. Upon penetrating a viscous target, a bullet experiences a force upon its frontal surface. If the bullet's frontal surface includes a cavity, some of the viscous material pushes into the cavity and applies a radial force to the inside of the cavity walls. This forces the cavity to open, in a process that is conventionally known as a 'mushrooming'. Bullets with such cavities on their tips (frontal surfaces) are colloquially referred to as hollow point bullets. A similar, albeit less effective, form of mushrooming is also possible with soft-point bullets where the bullet has a core made from or filled by a soft or frangible material such as lead or resin, which deforms or fractures upon target impact.

The cavity of a hollow point bullet is therefore provided in the tip (frontal surface) of a bullet to assist it to expand, effectively operating as the initiation point for expansion. Various configurations of such cavities are available, including open cavities, cavities filled with softer material such as lead, cavities with serrations, and so forth. Modern hollow point bullets are true "hollow" point bullets, in that they have open cavities in their tips that are not filled with another material.

A common feature of conventional hollow point bullets, especially those used for self-defence purposes, is that a hollow point bullet requires a significant force to reliably expand. Such a force is generally only achieved when a bullet is fired at very high speeds, achieved by loading the maximum, or very close to the maximum for the specific cartridge, amount of propellant in ammunition containing such bullets.

This has led to such ammunition being designated with labels such as "+P" and "+P+", since such ammunition causes very high pressures in a firearm when it is fired. Such loads are not recommended for older type firearms. Although such ammunition is safe in modern firearms, the recoil and noise from firing such ammunition especially in a handgun is significant. For inexperienced shooters it can be overwhelming. When used in an active emergency situation where ear protection is most likely not worn by the user, the noise and recoil can disorient or distract the shooter and compromise the shooter's ability to engage a target with follow-up shots, if required.

There is also a modern trend to using handguns with ever decreasing dimensions and lower weights, and these handguns are often referred to as compacts or micro-compacts. These handguns are easier to carry concealed for prolonged periods than their full-size counterparts, and they fit in well with the so-called 'everyday carry' approach. However, the use of ammunition loaded to the extreme pressures of "+P" and "+P+" loads ("hot loads") in these small size handguns is unpleasant, at the very least, even for experienced shooters. For inexperienced shooters, such hot loads may be uncontrollable.

As a result, people that use such small size handguns tend to train with 'practice loads' that are loaded to much lower pressures. This creates a level of proficiency with relatively low recoil ammunition, but that is at least to some extent a false sense of proficiency. In that context a gun owner will often distinguish between 'practice' ammunition and 'carry' ammunition. Most gun owners simply do not practice with their carry ammunition due to the high cost and the unpleasant nature of shooting such ammunition, the carry ammunition being hot loads.

This leaves such gun owners relatively inexperienced, and possibly dangerously inexperienced, in the handling of a firearm with the ammunition that they intend using for self-defence if they are unlucky enough to find themselves in that position. For self-defence that intended purpose is using carry ammunition and not target shooting with practice ammunition.

It is not an option to load conventional hollow point ammunition at lower pressures and use it for self-defence purposes, since such bullets do not reliably and predictably expand when fired at relatively low speeds. The effectiveness of conventional hollow point bullets used for self-defence purposes is severely diminished if they are not fired at a high speed, and doing so may effectively relegate an expensive hollow point bullet to provide the same performance as a full metal jacket bullet, which means there will be no or very little expansion upon target impact.

An additional negative effect of shooting bullets at high speeds is that the required high pressure also increases wear on the weapon, especially the barrel.

In the context of hunting a similar problem exists, where expansion is required even if overpenetration is not a factor to avoid. Hunting bullets are also often designed around firing them at very high speeds. Firing them at lower speeds do not achieve the require expansion, and therefore less damage to the target. In the case of meat hunters, a bullet that fails to expand and inflict maximum damage can result in a wounded animal that is not recovered. In the case of the hunting or culling of dangerous game that can result in a hunter being charged and injured or killed by the quarry.

There is a need for an expandable bullet that does not require high speeds for effective, reliable and predictable expansion.

OBJECTIVE OF THE INVENTION

It is an objective of the invention to provide an expandable bullet which at least partly overcomes the abovementioned problems.

SUMMARY OF THE INVENTION

In accordance with this invention there is provided an expandable bullet comprising a right circular cylindrical bullet base, a centre, and a tip;

with the bullet base having a diameter that is consistent with the calibre of the bullet;

with the bullet centre including at least one circumferential recess having a diameter smaller than the bullet base;

with the tip extending from the centre into a tip base and terminating in a front end that is provided with a circular cylindrical core;

with the tip being provided with a plurality of circumferentially spaced apart slits formed into the tip, with the slits including deep slits each extending from the tip to proximate the bullet base and shallow slits each extending from the tip to proximate the centre;

with the slits being circumferentially spaced apart around the tip and arranged alternatingly for each deep slit to be located between two shallow slits, and for each shallow slit to be located between two deep slits;

with the tip being provided with a plurality of deformable main petals equal in number to the number of deep slits and each main petal being comprised of a section of the tip located between two deep slits and each main petal including a shallow slit between the deep slits defining it, and with each main petal being comprised of a pair of small petals located on opposing sides of the shallow slit therein, and each main petal being connected to a main petal base located between the adjacent deep slits in the bullet base;

with each deep slit extending into the tip through the circumferential recess into the bullet base, and each shallow slit extending into the tip partly through the tip base to retain a segment of the tip base in place as a tab between the pair of small petals;

operatively for expansion of the bullet upon penetrating a target to be controlled by the tab connecting each pair of small petals, with initial expansion being limited by the tabs between the pairs of small petals, up to a predetermined degree of expansion where separation of each tab from at least one of the small petals to which it is connected occurs to enable further expansion to be controlled by its main petal base, operatively for the bullet to expand into its main petals each with two small petals.

There is further provided for the tip to be provided with a plurality of slits formed into the tip across the core through a longitudinal axis of the bullet, with each slit formed at an acute angle to the longitudinal axis and each slit extending deeper into the tip on a first side of the core than on second opposite side of the core, to form the main petals each with its set of two small petals in the tip.

There is still further provided of the centre to include at least a first and a second circumferential recess each having a diameter small than the bullet base and being spaced apart by a collar having substantially the same diameter as the bullet base; with the bullet base extending into the first circumferential recess and the centre terminating with the second circumferential recess and with the tip base extending from the second circumferential recess; and with each deep slit extending through the first circumferential recess into the bullet base, and each shallow slit extending partly through the tip base and partly through the second circumferential recess, to form the tab between the pair of small petals.

There is still further provided for the bullet to have an uneven number of slits equidistantly spaced apart around the circumference of the bullet tip, each comprising a deep slit on one side of the core and a shallow slit on an opposite side of the core.

There is further provided for the bullet to have three slits equidistantly spaced apart around the circumference of the bullet tip, each comprising a deep slit on one side of the core and a shallow slit on an opposite side of the core.

There is also provided for the bullet base to include a plurality of base ribs each with a diameter that is consistent with the calibre of the bullet, and to include circumferential recesses between the ribs forming base sections each having a diameter less that the calibre of the bullet, and preferably for the operative rear of the bullet to form a first base section, and for a first base rib to be located distal from the operative rear of the bullet.

There is also provided for the core to be comprised of a first core section and a second core section, with the first core section having a greater diameter than the second core section, and preferably for the second core section to extend into an operatively upper base section, and to terminate proximate its bottom, substantially at a position radially inward of an operatively central base rib.

There is still further provided for the tip base to have a diameter that is consistent with the calibre of the bullet, and preferably for the tip to extend from the tip base into a front end that is shaped in the form of a truncated cone.

These and other features of the invention are described in more detail below.

BRIEF DESCRIPTION OF THE DRAWINGS

A preferred embodiment of an expandable bullet according to the invention is described by way of example only and with reference to the accompanying drawings in which.

DETAILED DESCRIPTION OF THE INVENTION

Figure 1:
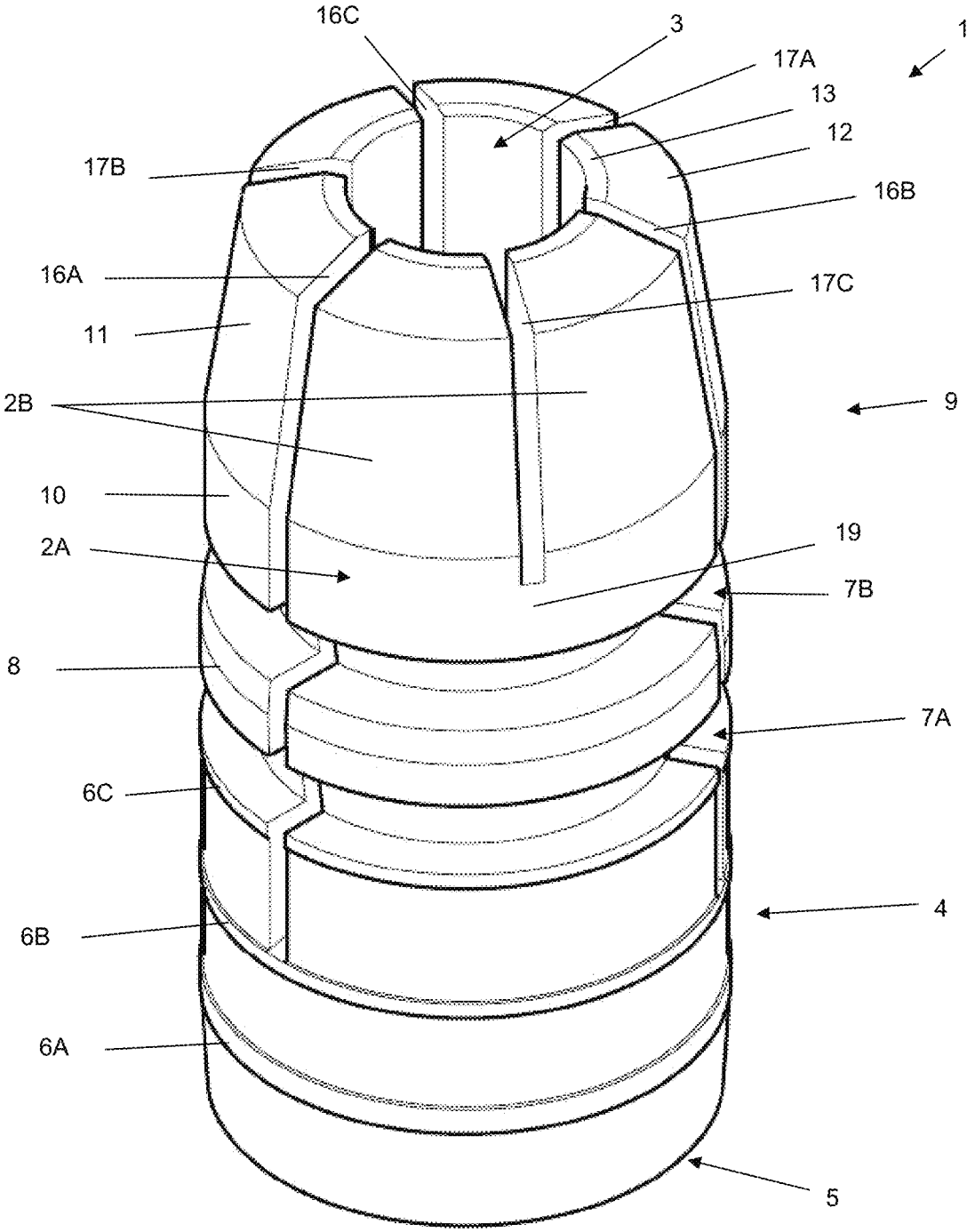
FIG. 1 is a front perspective view of a preferred embodiment of an expandable bullet according to the invention.
Figure 2:
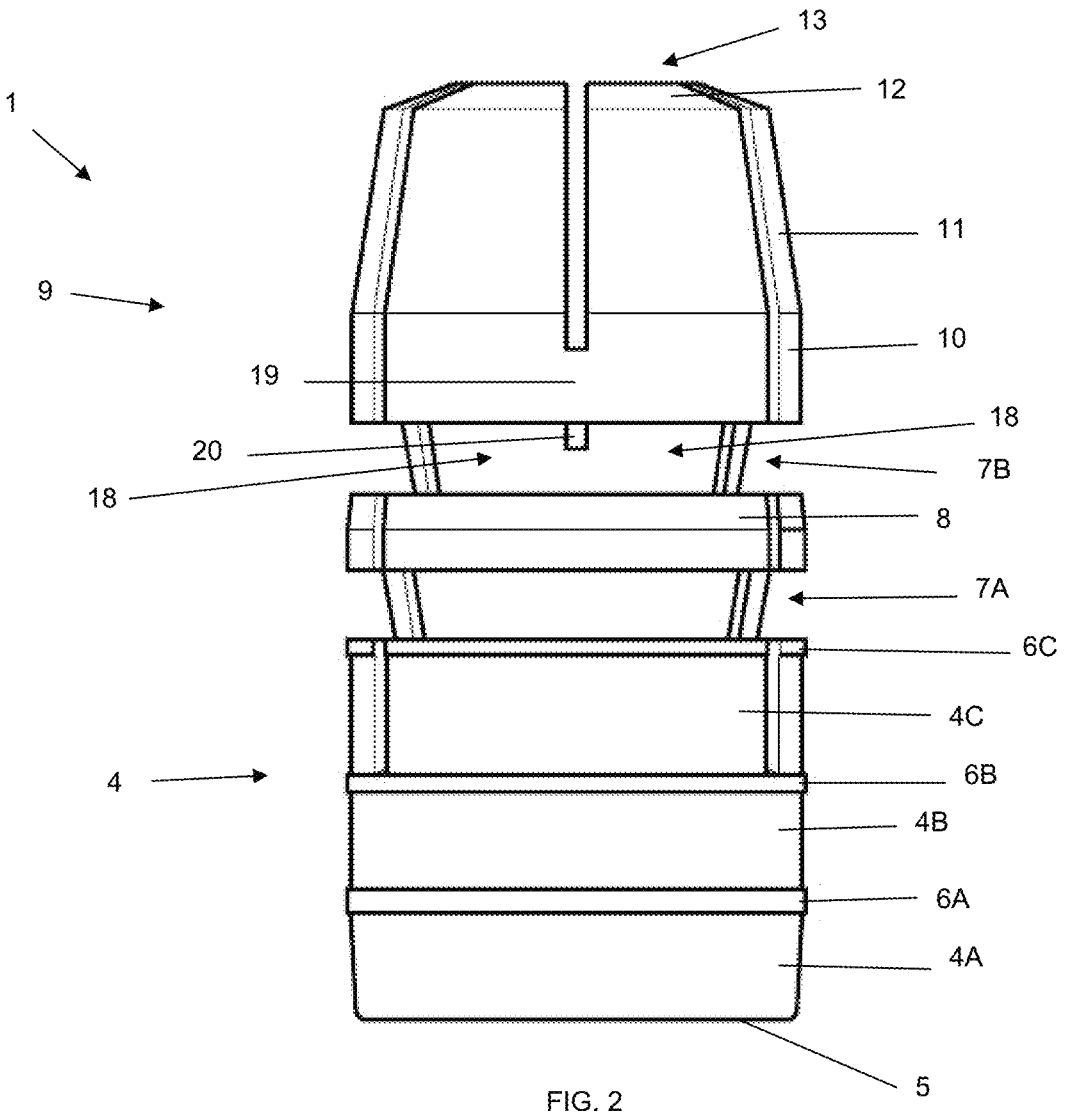
FIG. 2 is a side elevation view of the bullet of FIG. 1, showing a petal and a shallow cut.
Figure 3:
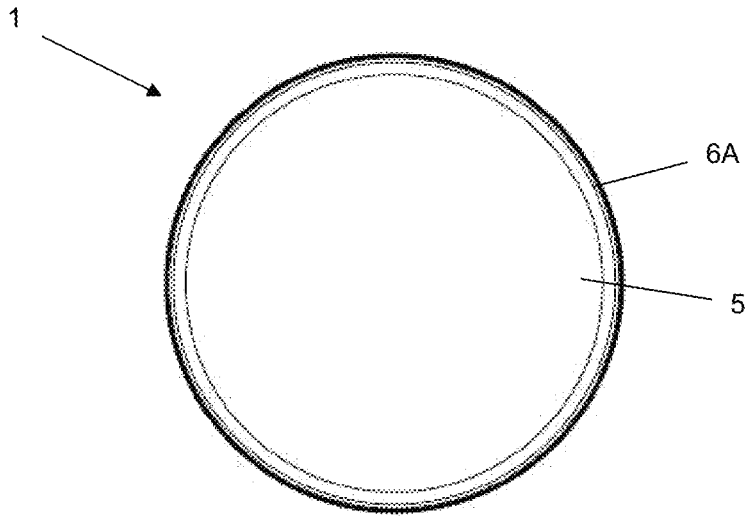
FIG. 3 is a rear end view of the bullet of FIG. 1.
Figure 4:
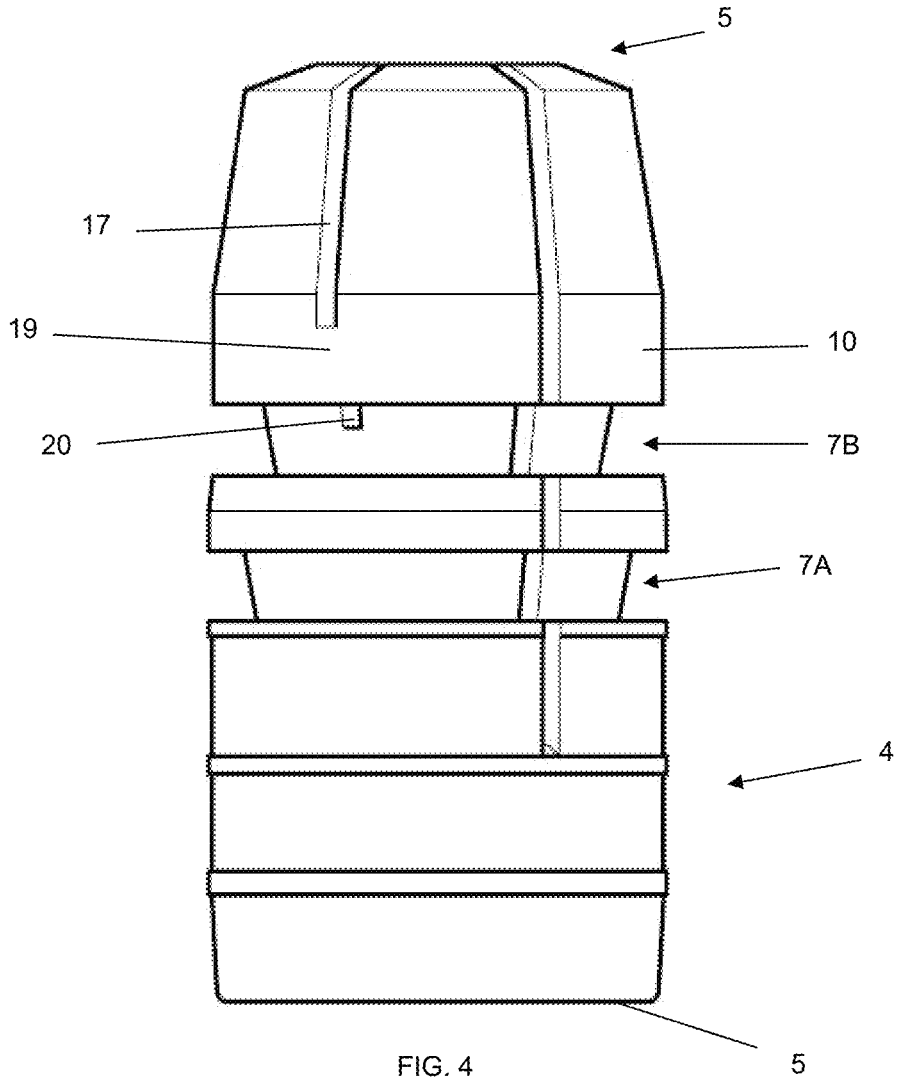
FIG. 4 is a side elevation view of the bullet of FIG. 1 showing shallow and deep cuts.
Figure 5:
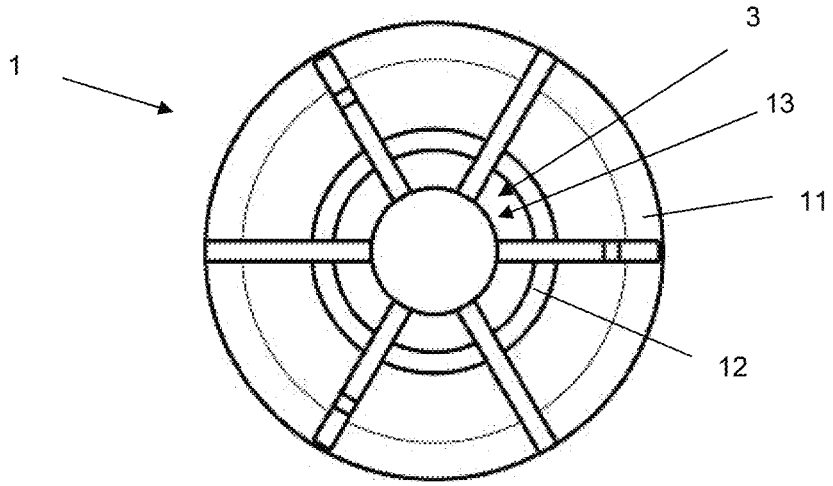
FIG. 5 is a front-end view of the bullet of FIG. 1.
Figure 6:
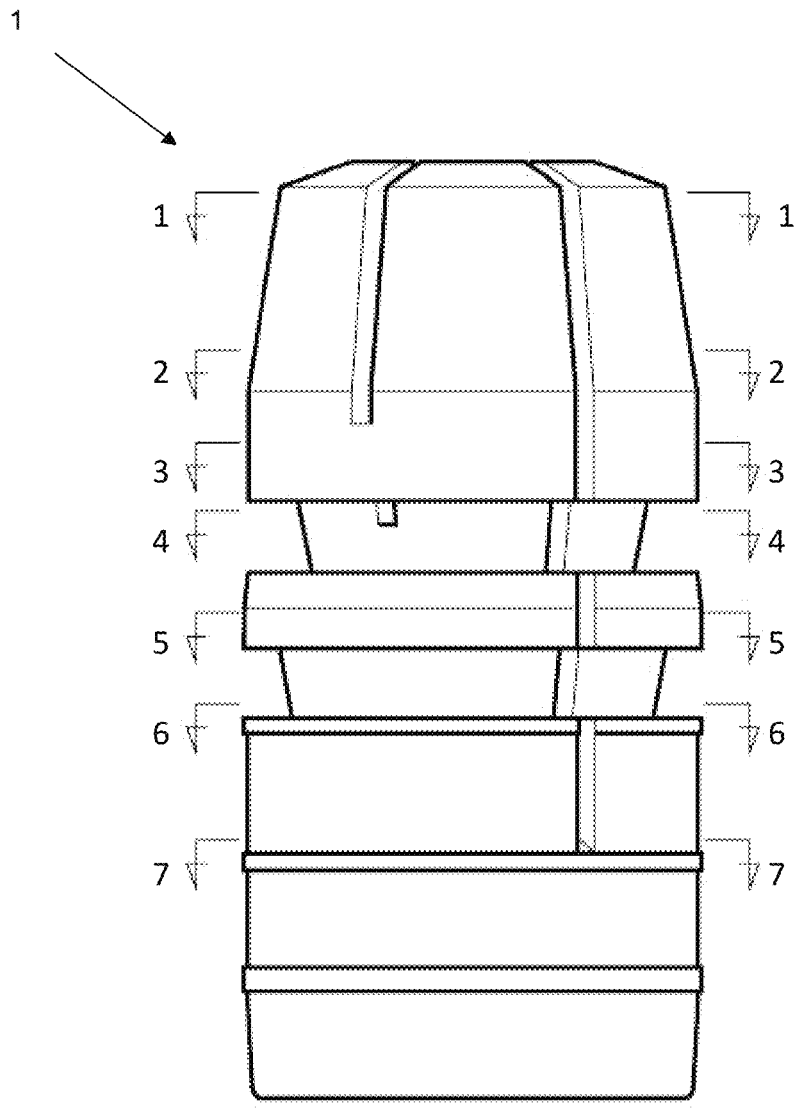
FIG. 6 is a side elevation view of the bullet of FIG. 1 showing the positions of transverse sections shown in FIGS. 7 to 13.
Figure 7:
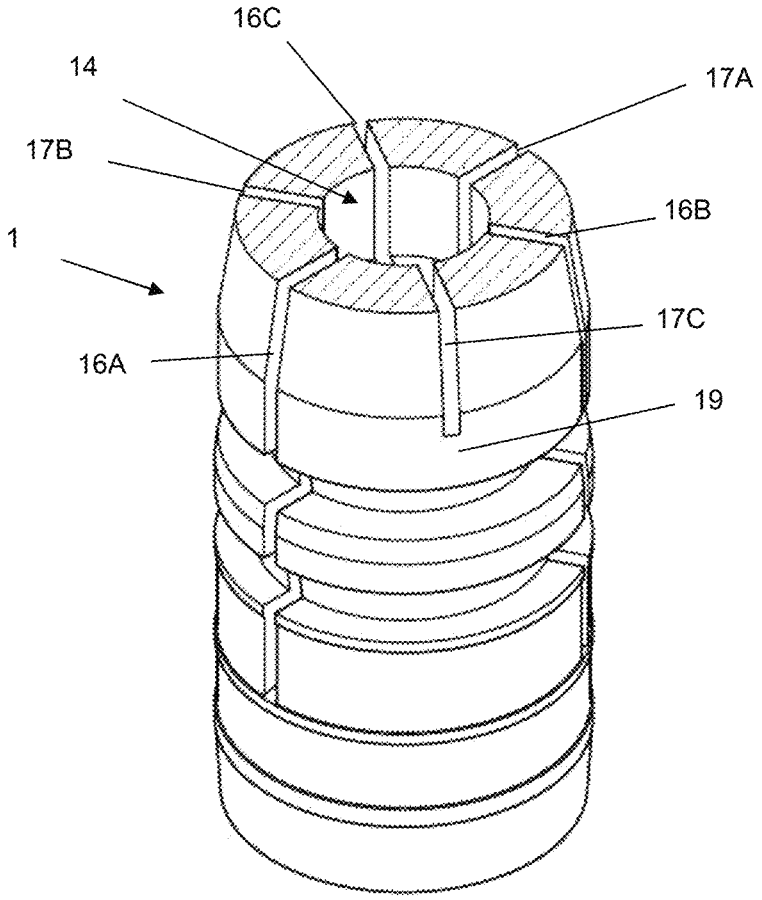
FIG. 7 is a front perspective view of the bullet of FIG. 1 at section 1-1 shown in FIG. 6.
Figure 8:
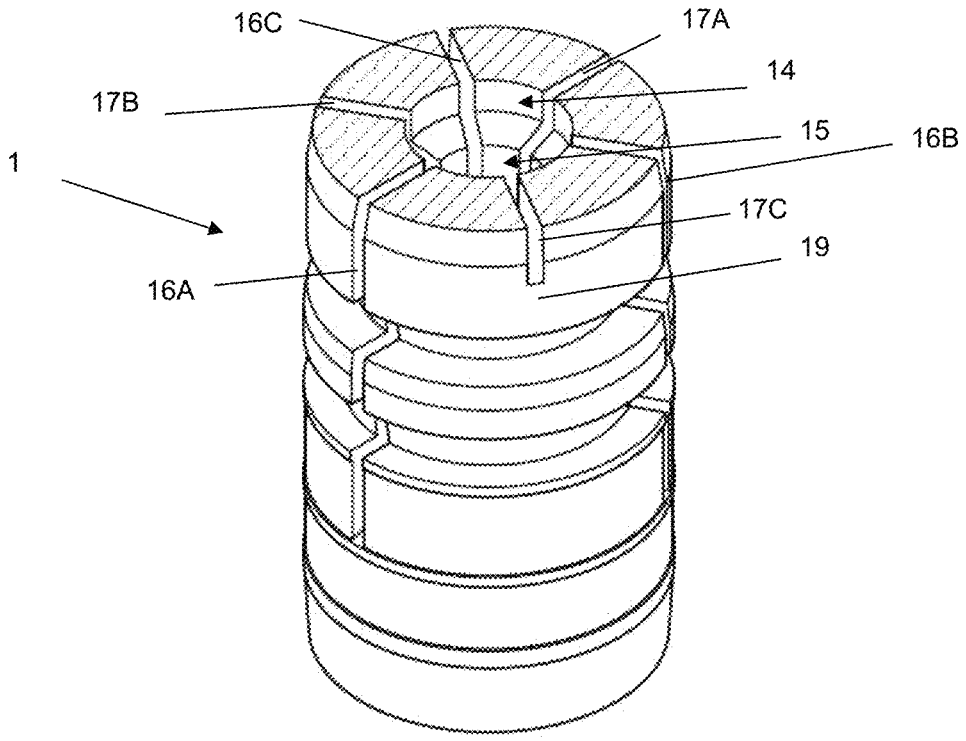
FIG. 8 is a front perspective view of the bullet of FIG. 1 at section 2-2 shown in FIG. 6.
Figure 9:
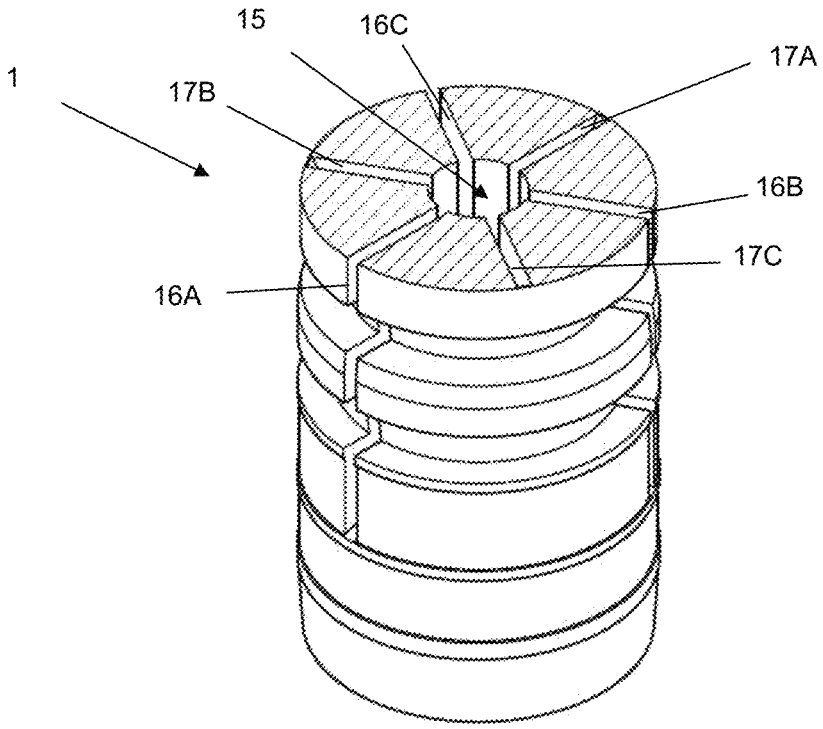
FIG. 9 is a front perspective view of the bullet of FIG. 1 at section 3-3 shown in FIG. 6.
Figure 10:
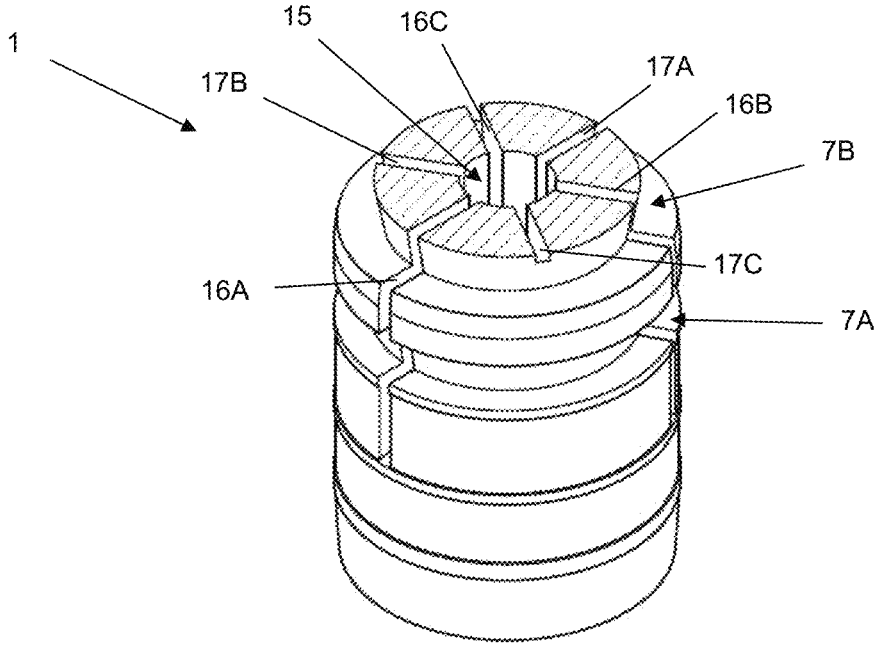
FIG. 10 is a front perspective view of the bullet of FIG. 1 at section 4-4 shown in FIG. 6.
Figure 11:
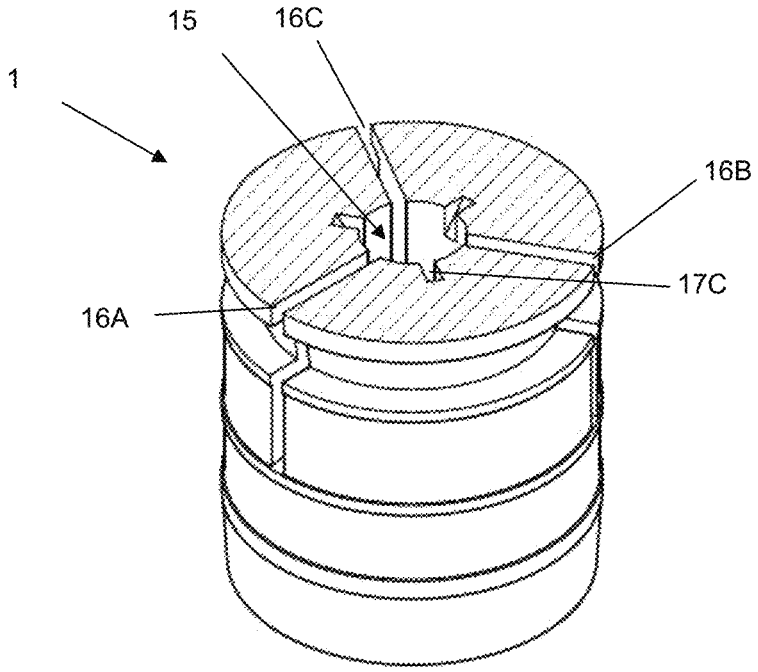
FIG. 11 is a front perspective view of the bullet of FIG. 1 at section 5-5 shown in FIG. 6.
Figure 12:
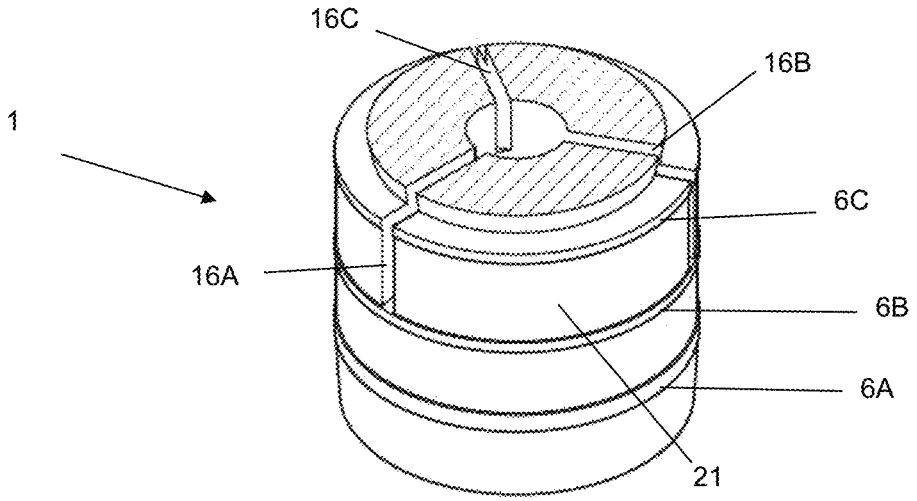
FIG. 12 is a front perspective view of the bullet of FIG. 1 at section 6-6 shown in FIG. 6.
Figure 13:
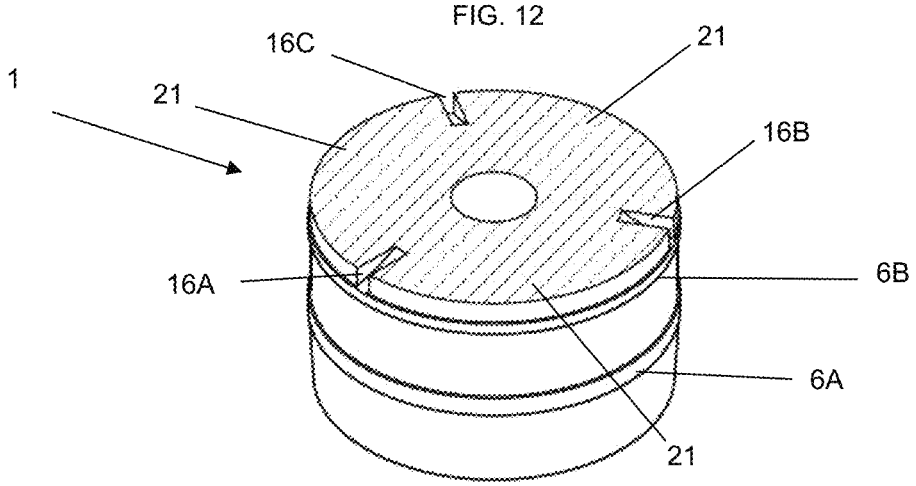
FIG. 13 is a front perspective view of the bullet of FIG. 1 at section 7-7 shown in FIG. 6.
Figure 14:
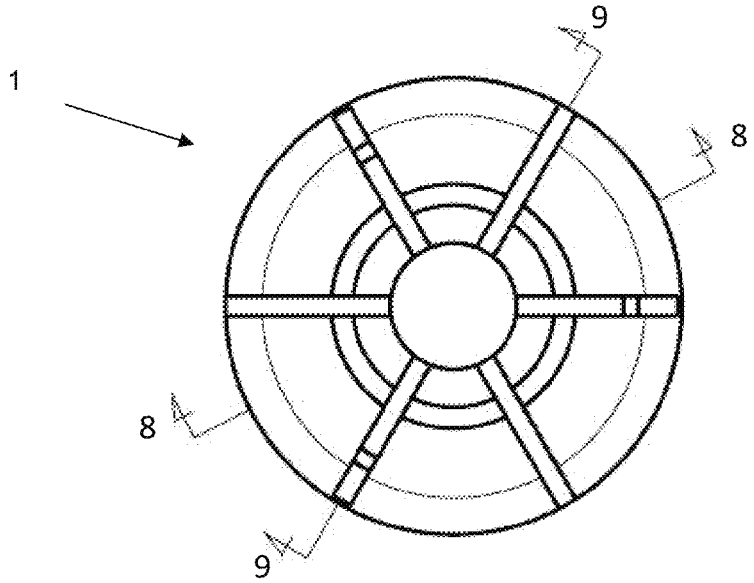
FIG. 14 is a front-end view showing the positions of longitudinal sections shown in FIGS. 15 and 16.

Before embodiments of the invention are explained in detail, it is to be understood that the invention is not limited in its application to the details of construction and the arrangement of components set forth in the following description or illustrated in the following drawings.

The invention is capable of other embodiments and of being practiced or of being carried out in various ways. Also, it is to be understood that the phraseology and terminology used herein is for the purpose of description and should not be regarded as limiting.

The use of "including," "comprising," or "having" and variations thereof herein is meant to encompass the items listed thereafter and equivalents thereof as well as additional items.

Unless specified or limited otherwise, the terms "mounted", "connected", "engaged" and variations thereof are used broadly and encompass both direct and indirect mountings, connections, supports, and couplings and are thus intended to include direct connections between two members without any other members interposed therebetween and indirect connections between members in which one or more other members are interposed therebetween. Further, "connected" and "engaged" are not restricted to physical or mechanical connections or couplings. Additionally, the words "lower", "upper", "upward", "down" and "downward" designate directions in the drawings to which reference is made.

The terminology includes the words specifically mentioned above, derivatives thereof, and words or similar import. It is noted that, as used in this specification and the appended claims, the singular forms "a," "an," and "the," and any singular use of any word, include plural referents unless expressly and unequivocally limited to one referent.

As used herein, the term "include" and its grammatical variants are intended to be non-limiting, such that recitation of items in a list is not to the exclusion of other like items that can be substituted or added to the listed items.

The drawings show an expandable self-defence bullet (1), which is designed to expand upon impact with a target. The bullet (1) includes a set of three main petals (2A) each of which includes a small petal pair (2B). The petals (2) are located circumferentially around a central hollow core (3) operatively forward of a right circular cylindrical base (4) at the operative rear end (5) of the bullet (1).

The resistance encountered by the bullet (1) from impacting a target causes the circumferential petals (2), including its main petals (2A) and small petal pairs (2B), to radially expand around its central hollow core (3) to increase the diameter of the bullet (1). The bullet (1), which rotates around its longitudinal axis after being fired, thus expands to a greater radius to effect greater damage on the target.

The bullet (1) has a right circular cylindrical base (4) at its operative rear end (5). The base (4) has a diameter that is consistent with the calibre of the bullet (1). The base (4) includes shallow circumferential ribs (6) which simultaneously act as aerodynamic elements and pressure reducing devices during loading of the bullet (1) into a shell casing (not shown). In this embodiment, the base (4) has three of these ribs (6A-C) which divides the base (4) into three base sections (4A, 4B, 4C). The base (4) can include more or less of the ribs (6) depending on the bullet weight and length, and the characteristics such as the barrel twist from which the bullet (1) is intended to be fired. The configuration of the bullet (1) is not limited to three of these ribs (6A-C).

Forward of the base (4), the bullet (1) includes two circumferential recesses (7A, 7B), of which the diameter is substantially smaller than the base (4). These recesses (7) are spaced apart by a single collar (8). A combination of the two circumferential recesses (7) weakens the three main petals (2A) as well as the small petal pairs (2B), described below, to enable their controlled deformation in use. The first circumferential recess (7A) weakens the three main petals (2A) while the second circumferential recess (7B) weakens the small petal pairs (2B), each located on top of a main petal (2A).

Still forward of the second circumferential recess (7B), the front end (9) of the bullet (1) includes a first section that forms a tip base (10) with a diameter substantially the same as the base (4), and forward of this the front end (9) is formed into a truncated cone (11), with a tip (12) of which the diameter sharply decreases to terminate in a truncated front end (13).

Figure 15:
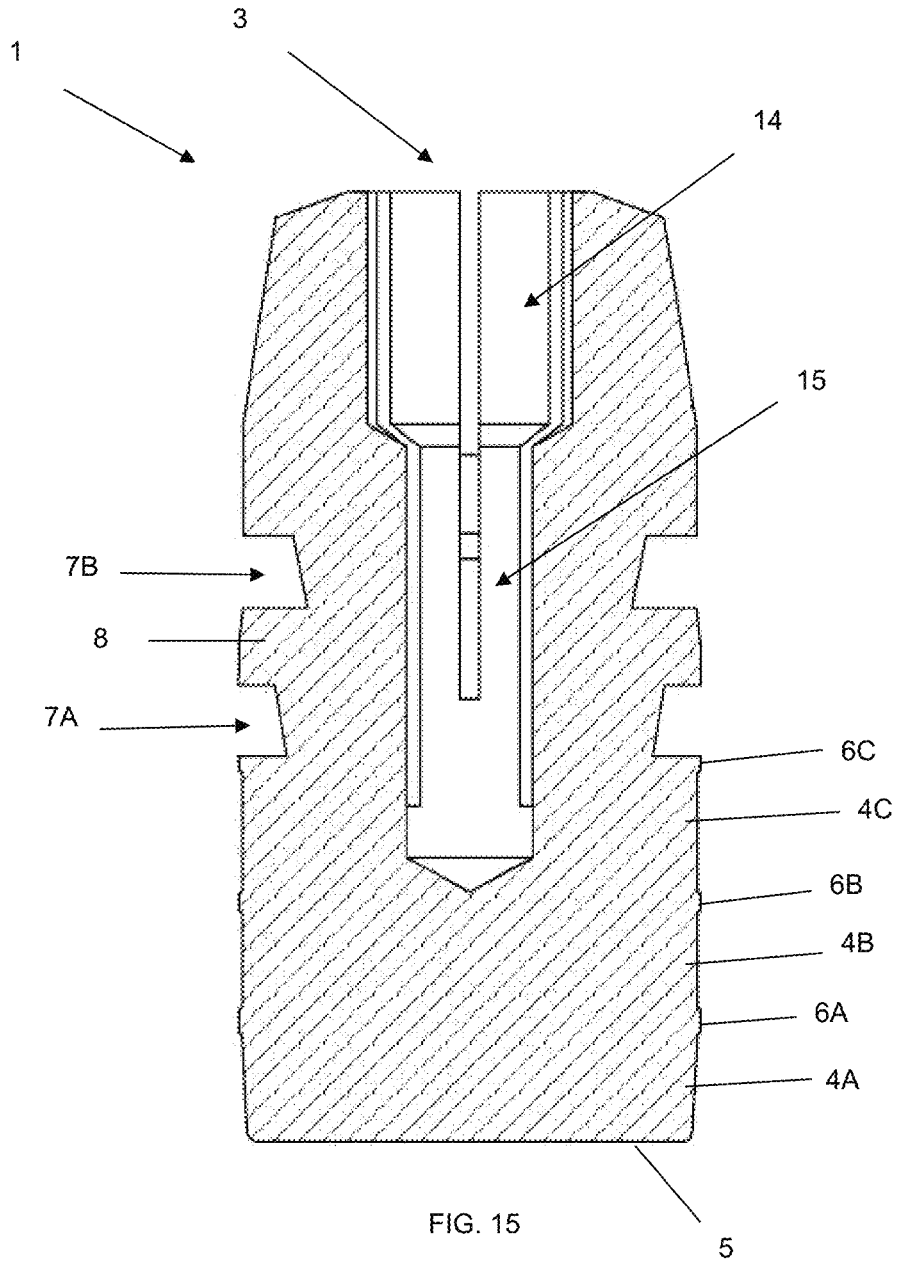
FIG. 15 is a section side elevation view of the bullet of FIG. 1 through section 8-8 shown in FIG. 15.
Figure 16:
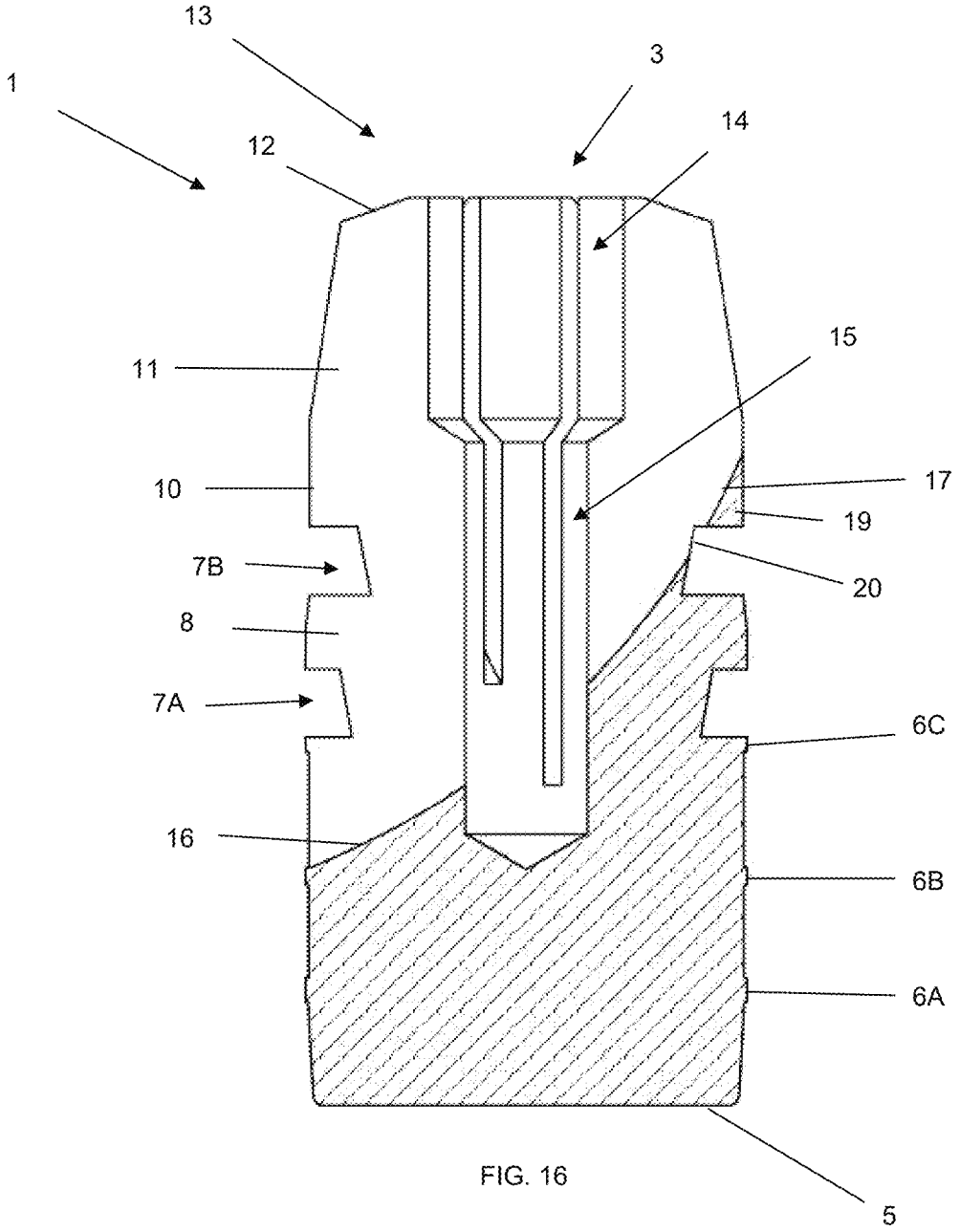
FIG. 16 is a section side elevation view of the bullet of FIG. 1 through section 9-9 shown in FIG. 15.

The central core (3) is formed into the bullet (1) from its front end (13) coaxially with its longitudinal axis to terminate in the base (4), as shown in FIGS. 15 and 16. The core (3) has a first core section (14) with a greater diameter than a deeper second core section (15). The second core section (15) extends into the top base section (4C), and terminates proximate its bottom, substantially at a position radially inward of the central rib (6B) on the base (4), as shown in FIGS. 15 and 16.

As shown in FIG. 1, the bullet (1) has six slots (16A-C, 17A-C) formed into its front end (13) across the tip (12). The six slots (16, 17) can be formed by a minimum of three slits (16A and 17A, 16B and 17B, 16C and 17C) through the longitudinal axis. Each slit (16A and 17A, 16B and 17B, 16C and 17C) simultaneously creates, on the near side of the longitudinal axis through a deep slit (16A, 16B and 16C) the base of two main petals (2A), and on the opposite side of the longitudinal axis two small petals (2B) through a shallow slit (17A, 17B and 17C) into the opposite main petal (2A). The shallow and deep slits (16, 17) are arranged alternatingly to form a slit pattern of each shallow slit (17) being located between two deep slits (16), and each deep slit (16) being located between two shallow slits (17). The combination of the three deep and shallow slits (16, 17) forms three main petals (2A) with each main petal divided at the top into a smaller petal pair (2B). Each main petal (2A) is located between and formed by two deep slits. Viewed anti-clockwise in FIG. 1, these deep slit combinations include the main petals (2A) formed between 16A and 16B, between 16B and 16C, and between 16C and 16C. There is a clear distinction between the three main petals (2A) that are all rooted in the solid circular cylindrical base (4) and extending towards the bullet's front end (13) where each main petal (2A) is divided into two small petals (2B).

The deep slits (16) define the length of the three main petals (2A). Each main petal (2A) is divided around the middle of the length of the petal by the two circumferential recesses (7A, 7B). The first circumferential recess (7A) determines the extent to which each main petal (2A) can bend and expand. The position of the top second circumferential recess (7B) determines the length of the small petals (2B) as well as the allowable extent of bending of the small petal pair (2B).

The shallow slit (17) in each main petal (2A) assists to control expansion of the small petal pair (2B) where each small petal (2B) hinges at its base (18) because of the location of the second circumferential recess (7B). Each shallow slit (17) does not fully cut though the top cone (10), but it does cut (20) into the second circumferential recess (7B), which is the first recess from the front end (13). The second circumferential recess (7B) allows the two small petals (2B) to bend outwards with minimum force, each hinging around its based (18). To prevent premature expansion of the petals (2), a narrow tab (19) of material is retained in the lower outer corner of the shallow slit (17), shown in FIGS. 1, 2, 4, 7, 8, and 16, where the small petals are radially joined to each other. This tab (19) is configured to reinforce the two small petals (2B). This tab (19) prevents premature bending of the small petal pair (2B) due to centrifugal forces while the bullet (1) is spinning through the air prior to impact.

After impact, the increased viscosity in the target medium initiates expansion of the small petal pair (2B) to a point that the tab (19) stretches and fractures. Once the tab (19) breaks apart each small petal (2B) is released to expand and hinge due to the second circumferential section (7B).

Figure 17:
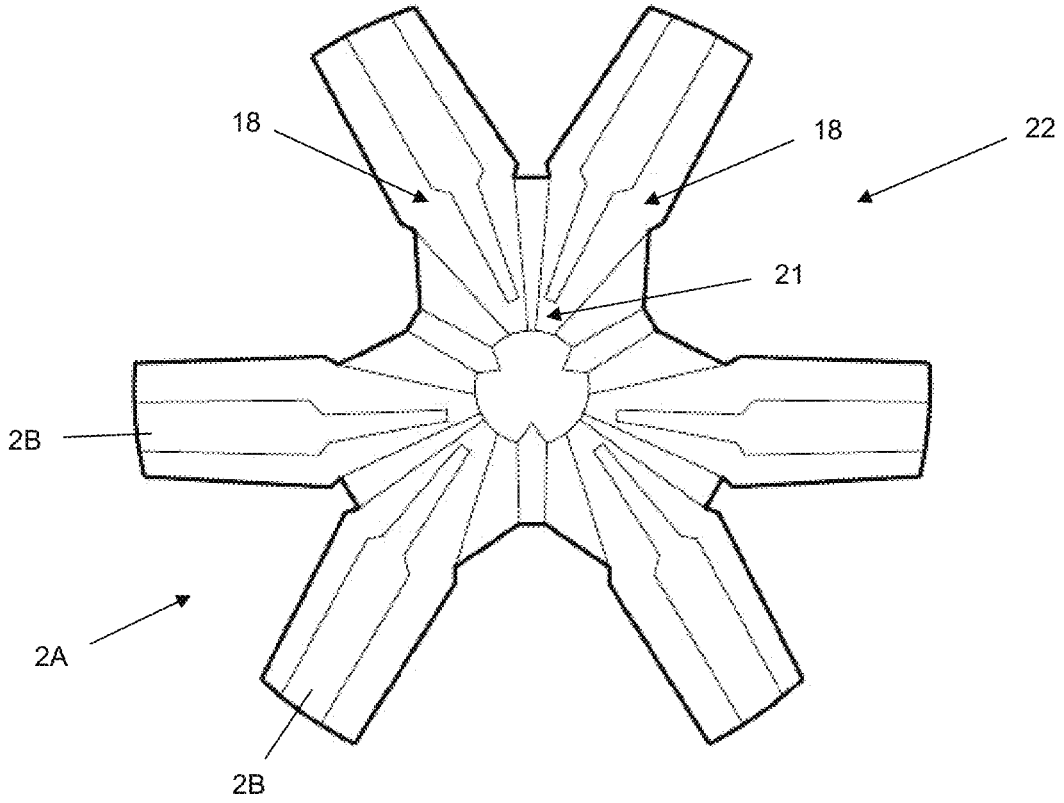
FIG. 17 is a front-end view of the bullet of FIG. 1 expanded after use.
Figure 18:
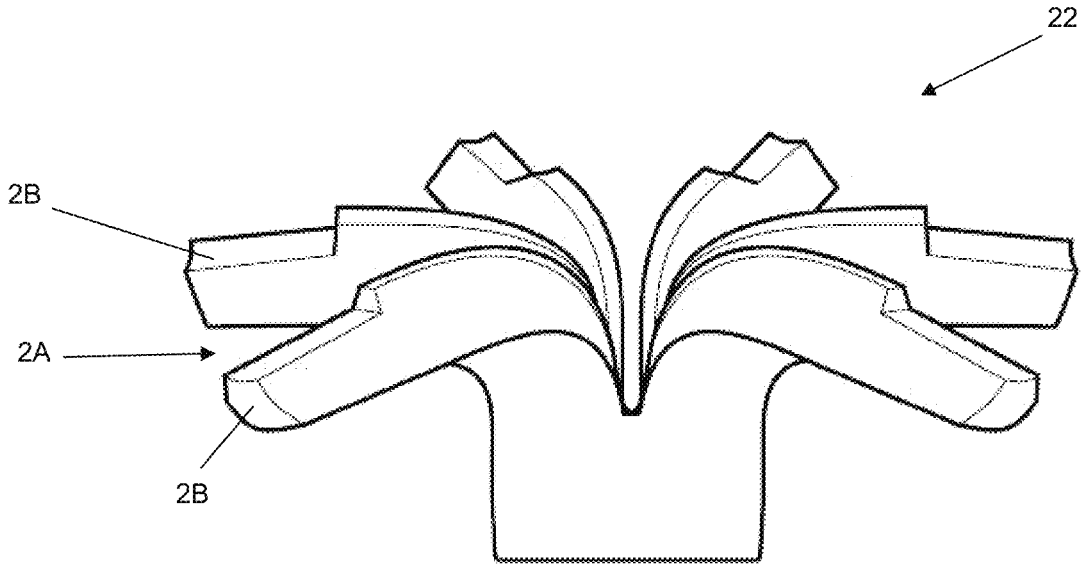
FIG. 18 is a side elevation view of the expanded bullet shown in FIG. 17.

As the small petals (2B) open, increased forces act on the base (21) of each main petal (2A), and they will start to bend outwards. At such time the six small petals (2B) are fully deformed, causing further expansion forces to pull the three main petals (2A) open to expand outwards. As each main petal (2A) bends open, the forces acting on it increase to the point where equilibrium is reached according to the impact velocity to determine the final shape of the impacted bullet (22) with all petals (2A, 2B) opened, as shown in FIGS. 17 and 18. Thus, the bullet (1) expands (22) into three main petals (2A), each with two small petals (2B), instead of just into six smaller petals that will be more prone to failure and breaking off upon penetration of a target.

It should be noted that the opening of the petals (2A, 2B) is progressive and dependent on the impact velocity and the viscosity of the target medium. The extent to which the petals (2A, 2B) open is smaller for lower impact velocities and greater for faster impact velocities such that the function is maintained. It is a feature of the configuration of the bullet (1) to allow proper petal (2A, 2B) expansion for supersonic as well as subsonic bullet velocities.

It will be appreciated that the embodiment described above is given by way of example only and is not intended to limit the scope of the invention. It is possible to alter aspects of the embodiment without departing from the essence of the invention.

The invention claimed is:

1. An expandable bullet, comprising:

a right circular cylindrical bullet base;

a centre; and a tip;

with the bullet base having a diameter that is consistent with the calibre of the bullet;

with the bullet centre including at least one circumferential recess having a diameter smaller than the bullet base;

with the tip extending from the centre into a tip base and terminating in a front end that is provided with a circular cylindrical core;

with the tip being provided with a plurality of circumferentially spaced apart slits formed into the tip, with the slits including deep slits each extending from the tip to proximate the bullet base and shallow slits each extending from the tip to proximate the centre;

with the slits being circumferentially spaced apart around the tip and arranged alternatingly for each deep slit to be located between two shallow slits, and for each shallow slit to be located between two deep slits;

with the tip being provided with a plurality of deformable main petals equal in number to the number of deep slits and each main petal being comprised of a section of the tip located between two deep slits and each main petal including a shallow slit between the deep slits defining it, and with each main petal being comprised of a pair of small petals located on opposing sides of the shallow slit therein, and each main petal being connected to a main petal base located between the adjacent deep slits in the bullet base;

with each deep slit extending into the tip through the circumferential recess into the bullet base, and each shallow slit extending into the tip partly through the tip base to retain a segment of the tip base in place as a tab between the pair of small petals;

operatively for expansion of the bullet upon penetrating a target to be controlled by the tab connecting each pair of small petals, with initial expansion being limited by the tabs between the pairs of small petals, up to a predetermined degree of expansion where separation of each tab from at least one of the small petals to which it is connected occurs to enable further expansion to be controlled by its main petal base, operatively for the bullet to expand into its main petals each with two small petals.

2. The bullet as claimed in claim 1 in which the tip is provided with a plurality of slits formed into the tip across the core through a longitudinal axis of the bullet, with each slit formed at an acute angle to the longitudinal axis and each slit extending deeper into the tip on a first side of the core than on second opposite side of the core, to form the main petals each with its set of two small petals in the tip.

3. The bullet as claimed in claim 1 in which the centre includes at least a first and a second circumferential recess each having a diameter small than the bullet base and being spaced apart by a collar having substantially the same diameter as the bullet base;

with the bullet base extending into the first circumferential recess and the centre terminating with the second circumferential recess and with the tip base extending from the second circumferential recess; and with each deep slit extending through the first circumferential recess into the bullet base, and each shallow slit extending partly through the tip base and partly through the second circumferential recess, to form the tab between the pair of small petals.

4. The bullet as claimed in claim 1 which has an uneven number of slits equidistantly spaced apart around the circumference of the bullet tip, each comprising a deep slit on one side of the core and a shallow slit on an opposite side of the core.

5. The bullet as claimed in claim 1 which has three slits equidistantly spaced apart around the circumference of the bullet tip, each comprising a deep slit on one side of the core and a shallow slit on an opposite side of the core.

6. The bullet as claimed in claim 1 in which the bullet base includes a plurality of base ribs each with a diameter that is consistent with the calibre of the bullet, and the bullet base includes circumferential recesses between the ribs forming base sections each having a diameter less that the calibre of the bullet.

7. The bullet as claimed in claim 6 in which the operative rear of the bullet forms a first base section, and a first base rib is located distal from the operative rear of the bullet.

8. The bullet as claimed in claim 1 in which the core is comprised of a first core section and a second core section, with the first core section having a greater diameter than the second core section.

9. The bullet as claimed in claim 8 in which the second core section extends into an operatively upper base section, and terminates proximate its bottom, substantially at a position radially inward of an operatively central base rib.

10. The bullet as claimed in claim 1 in which the tip base has a diameter that is consistent with the calibre of the bullet.

11. The bullet as claimed claim 1 in which the tip extends from the tip base into a front end that is shaped in the form of a truncated cone.

* * * * *